US009572745B2

(12) United States Patent
Lin

(10) Patent No.: US 9,572,745 B2
(45) Date of Patent: Feb. 21, 2017

(54) MASSAGE ROLLER DEVICE

(71) Applicant: Yung-Chih Lin, Tainan (TW)

(72) Inventor: Yung-Chih Lin, Tainan (TW)

( * ) Notice: Subject to any disclaimer, the term of this patent is extended or adjusted under 35 U.S.C. 154(b) by 348 days.

(21) Appl. No.: 14/167,900

(22) Filed: Jan. 29, 2014

(65) Prior Publication Data

US 2015/0209220 A1 Jul. 30, 2015

(51) Int. Cl.
*A61H 15/00* (2006.01)

(52) U.S. Cl.
CPC ... *A61H 15/0092* (2013.01); *A61H 2015/0021* (2013.01); *A61H 2201/0192* (2013.01); *A61H 2201/169* (2013.01)

(58) Field of Classification Search
CPC ..... A61H 15/00; A61H 15/0092; A61H 2015/0014; A61H 2201/1253; A61H 2201/1657; A61H 2201/1671; A61H 2201/169; A61H 2201/1692; A61H 2201/1695; Y10T 403/7005; F16B 21/02; F16B 12/2009; F16B 5/0092; F16L 37/24
USPC ..... 601/120, 121–125, 134–135; 403/348
See application file for complete search history.

(56) References Cited

U.S. PATENT DOCUMENTS 1,882,370 A * 10/1932 Schroeder ..... A61H 15/0092 215/398
2,448,797 A * 9/1948 Gustlin ..... A61H 15/00 482/79
2,546,095 A * 3/1951 Walter ..... A61H 15/02 165/177
2,800,743 A * 7/1957 Meehan ..... A63H 33/084 446/127
3,185,503 A * 5/1965 Angle ..... F16L 37/24 285/361
3,605,648 A * 9/1971 Petix et al. ..... A47J 43/28 425/193
3,630,527 A * 12/1971 Breslow ..... A63F 9/12 273/157 R
3,847,144 A * 11/1974 Wright ..... A61H 15/0092 401/8
3,858,579 A * 1/1975 Ching ..... A61H 15/0092 601/120
5,407,413 A * 4/1995 Kupferman ..... A63B 21/0728 482/106
5,553,856 A * 9/1996 Barnard ..... A63F 9/0098 273/156
5,554,102 A * 9/1996 Chiou ..... A61H 15/0092 601/118
6,280,371 B1 * 8/2001 Krippelz ..... B23P 15/00 29/895.213

(Continued)

*Primary Examiner* — Valerie L Woodward
*Assistant Examiner* — Christopher Miller

(57) ABSTRACT

A massage roller device includes a body having a tube and an outer layer. The tube is rigid and includes a receiving portion having two openings. A first coupling portion is provided in each opening. The outer layer is made of a soft material and is mounted around the tube. The massage roller device further includes two covers made of a rigid material are provided. Each cover covers one of the openings of the body. Each cover includes a lid having an inner side and an outer side opposite to the inner side. A second coupling portion is provided on the inner side of each lid. Two engagement pegs are formed on the outer side of each lid. Two engagement grooves are defined in the outer side of each lid.

3 Claims, 12 Drawing Sheets

(56) References Cited

U.S. PATENT DOCUMENTS

| | | | | |
|---|---|---|---|---|
| 6,398,694 | B1 * | 6/2002 | Bountourakis | A63B 21/00069 482/109 |
| 6,722,807 | B1 * | 4/2004 | Cornet | B62D 29/048 403/2 |
| 7,223,251 | B1 * | 5/2007 | Cassidy | A61H 15/0092 601/118 |
| 2006/0241537 | A1 * | 10/2006 | Liu | A61H 15/0092 601/118 |
| 2009/0082178 | A1 * | 3/2009 | Oliver | A63B 69/004 482/83 |
| 2010/0016768 | A1 * | 1/2010 | Liu | A61H 23/0254 601/46 |
| 2011/0301000 | A1 * | 12/2011 | Pullen | A61H 1/0281 482/109 |
| 2012/0065557 | A1 * | 3/2012 | Phillips | A61H 15/0092 601/99 |
| 2012/0310125 | A1 * | 12/2012 | Hall | A61H 15/0085 601/120 |
| 2013/0178768 | A1 * | 7/2013 | Dalebout | A61H 15/0092 601/46 |
| 2014/0128786 | A1 * | 5/2014 | Ross | A61H 15/0092 601/118 |
| 2015/0005146 | A1 * | 1/2015 | Chen | A63B 21/00047 482/142 |

* cited by examiner

A – A

B - B

C – C

MASSAGE ROLLER DEVICE

BACKGROUND OF THE INVENTION

The present invention relates to a massage roller device and, more particularly, to a massage roller device that can be connected to a similarly constructed massage roller device to increase the overall length or can be coupled with a handle which can be received in the massage roller device when not in use.

Rollers are often used in yoga or massage as an auxiliary tool. FIG. 12 shows a conventional roller for yoga or massage. The roller 1' includes a rigid hollow tube 11' and a soft outer layer 12' around the tube 11'. The outer layer 12' includes a plurality of protrusions 121' for rolling contact with different body portions of a user while providing a comfortable massage effect during contact.

However, the roller 1' has a fixed length such that the user must prepare rollers of different lengths for differing needs, increasing the costs and causing inconvenience to carriage. Furthermore, the roller 1' can not easily be gripped and does not provide any storage function, providing poor utility and limited applications.

BRIEF SUMMARY OF THE INVENTION

An objective of the present invention is to provide a massage roller device that can be connected to a similarly constructed massage roller device to increase the overall length or can be coupled with a handle which can be received in the massage roller device when not in use, increasing utility of the massage roller device.

A massage roller device according to the present invention includes a body having a tube and an outer layer. The tube is rigid and includes a receiving portion having two openings. A first coupling portion is provided in each opening. The outer layer is made of a soft material and is mounted around the tube. The massage roller device further includes two covers made of a rigid material are provided. Each cover covers one of the openings of the body. Each cover includes a lid having an inner side and an outer side opposite to the inner side. A second coupling portion is provided on the inner side of each lid. Two engagement pegs are formed on the outer side of each lid. Two engagement grooves are defined in the outer side of each lid.

Preferably, each engagement peg on each lid includes an enlarged head. Each engagement groove of each lid includes an insertion portion and a coupling portion. The insertion portion has a width larger than a width of each enlarged head of each lid. The coupling portion has a width smaller than the width of each enlarged head of each lid.

Preferably, each lid includes an insertion hole in a center thereof. A handle includes two handle parts. Each handle part removably extends through the insertion hole of one of the lids. The handle parts can be detachably coupled with each other.

Preferably, one of the handle parts includes an end having a thread. The other handle part includes an end having a screw hole. The thread of one of the handle parts is threadedly engaged in the screw hole of the other handle part. Each handle part includes a flange having an outer diameter larger than a diameter of the insertion hole of each lid. The flange on each handle part abuts the outer side of one of the lids.

Preferably, each first coupling portion of the body includes an inner thread. The second coupling portion of each cover includes a cylindrical portion having an outer thread threadedly engaged with the inner thread of one of the first coupling portions of the body.

Preferably, the insertion hole of each lid includes a toothed inner periphery. The toothed inner periphery is adapted to be extended and driven by a finger of a user.

The present invention will become clearer in light of the following detailed description of illustrative embodiments of this invention described in connection with the drawings.

DETAILED DESCRIPTION OF THE INVENTION

Figure 1:
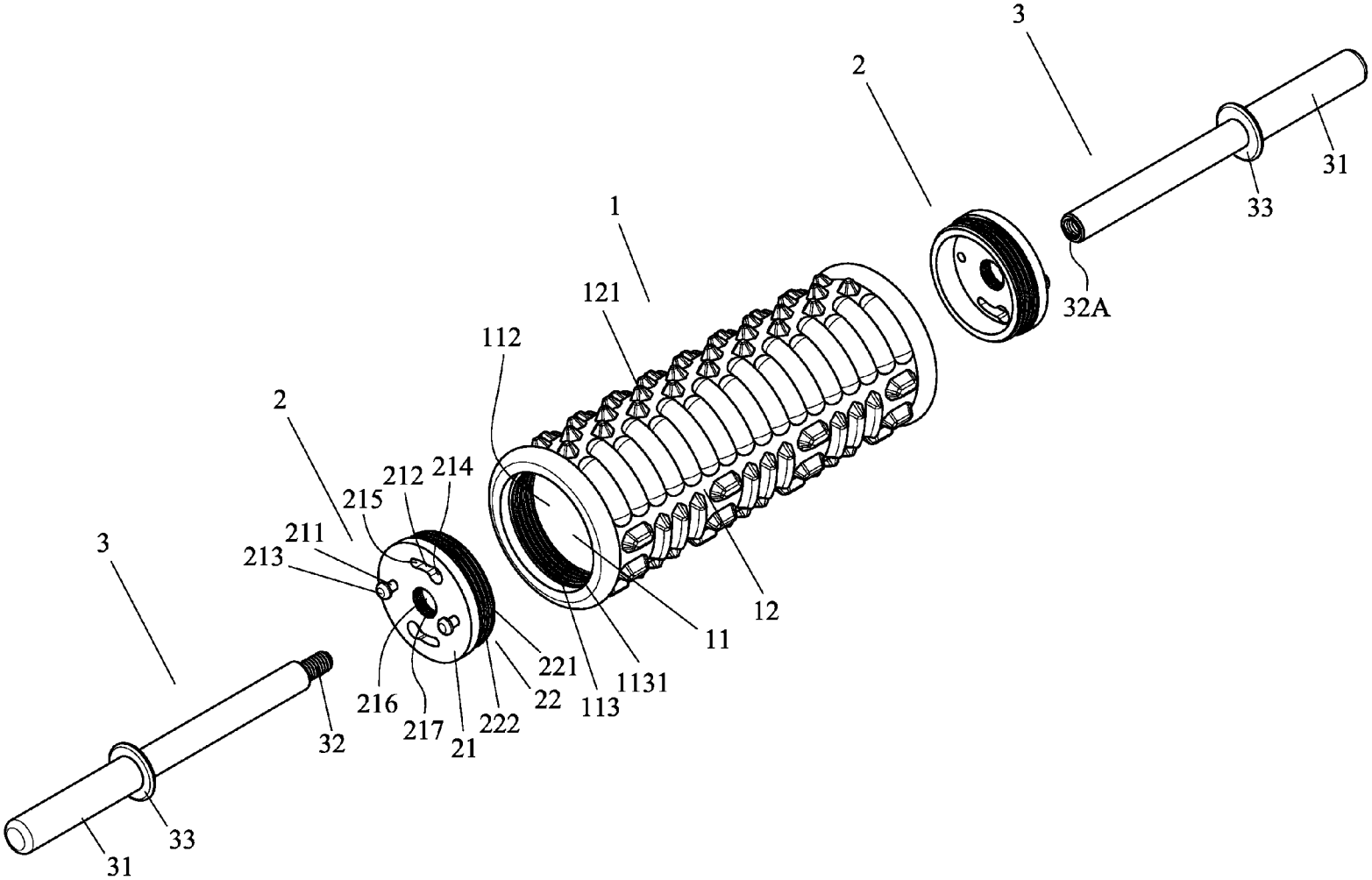
FIG. 1 is an exploded, perspective view of a massage roller device of a first embodiment according to the present invention.
Figure 2:
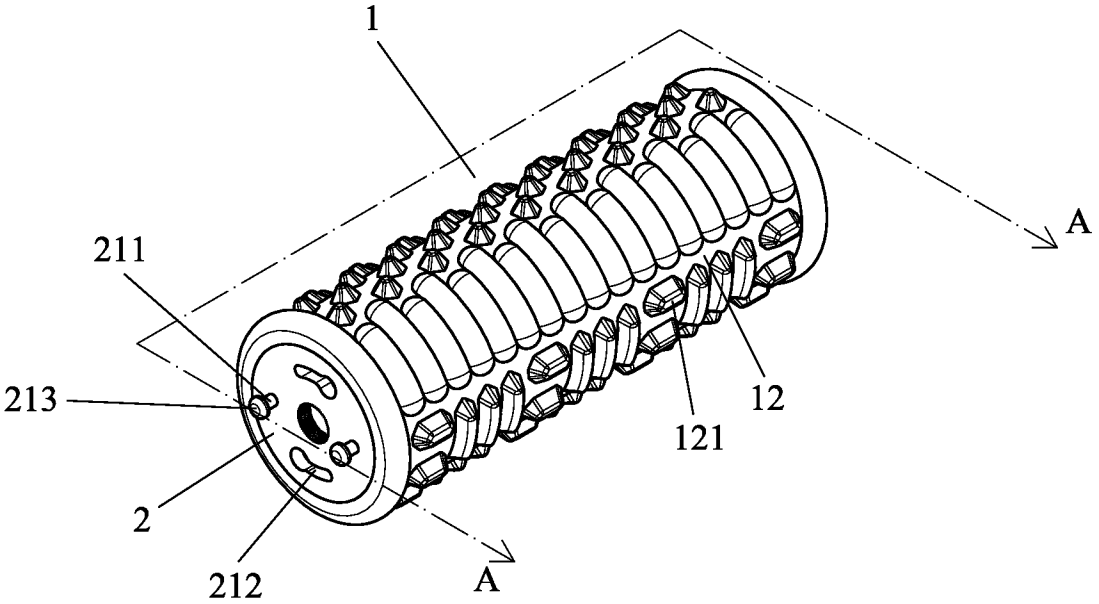
FIG. 2 is a perspective view of the massage roller device of FIG. 1.
Figure 3:
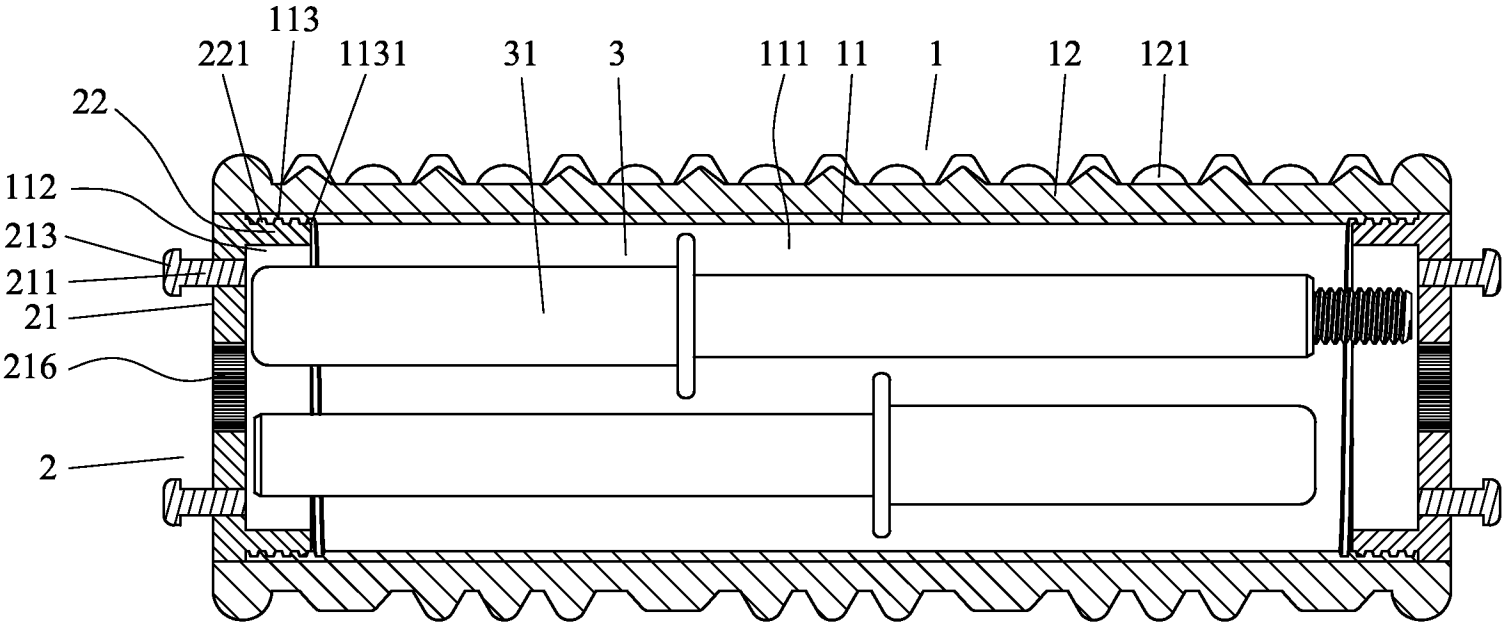
FIG. 3 is a cross sectional view taken along section line A-A of FIG. 2.
Figure 4:
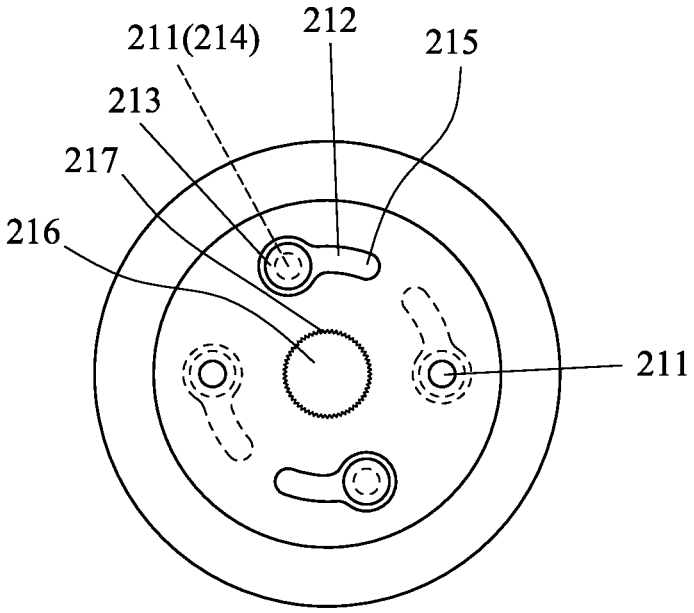
FIG. 4 is an end view illustrating coupling of the massage roller device of FIG. 2 with another massage roller device.
Figure 5:
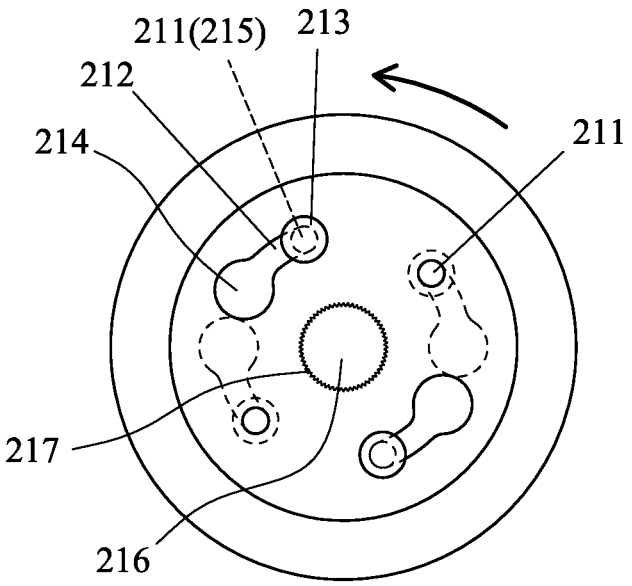
FIG. 5 is a view similar to FIG. 4, with the massage roller devices coupled together.
Figure 6:
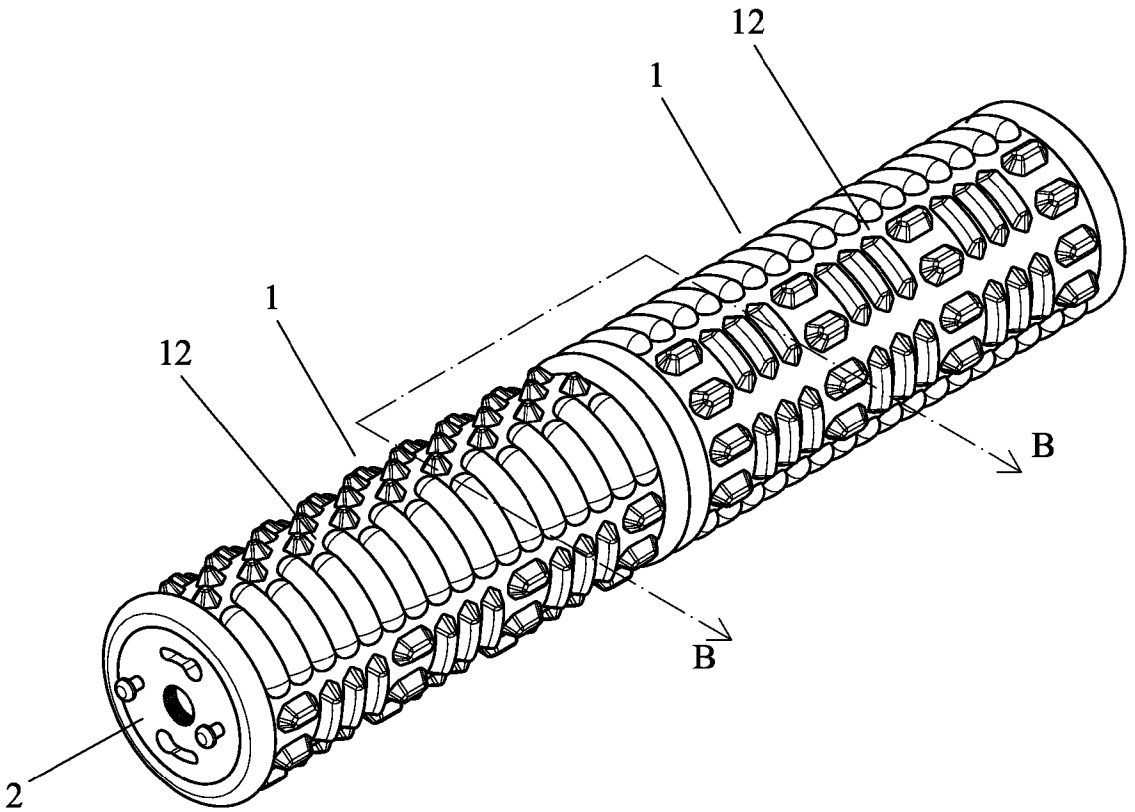
FIG. 6 is a perspective view of two massage roller devices coupled together.
Figure 7:
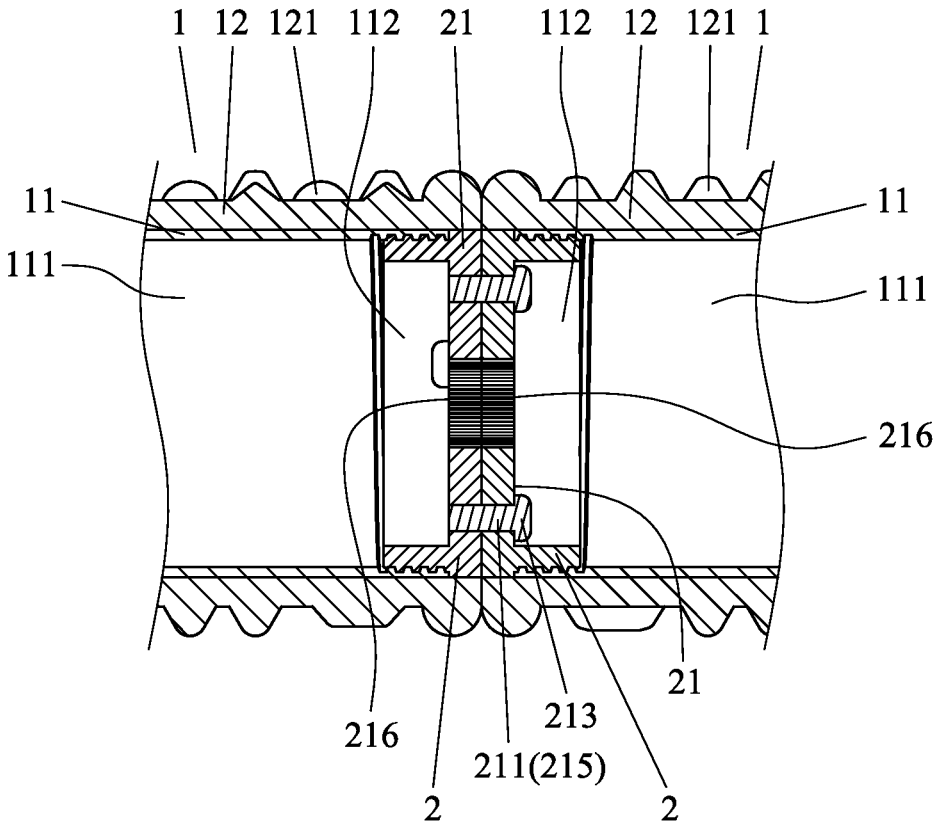
FIG. 7 is a cross sectional view taken along section line B-B of FIG. 6.

With reference to FIGS. 1-3, a massage roller device of a first embodiment according to the present invention includes a body 1, two covers 2, and a handle 3. The body 1 includes a tube 11 and an outer layer 12. The tube 11 is rigid and includes a receiving portion 111 having two openings 112. A first coupling portion 113 is provided in each opening 112 and has an inner thread 1131. The outer layer 12 is made of a soft material, is mounted around the tube 11, and includes a plurality of massaging protrusions 121.

Each cover 2 is made of a rigid material and covers one of the openings 112 of the body 1. Each cover 2 includes a lid 21 having an inner side and an outer side opposite to the inner side. A second coupling portion 22 is provided on the inner side of each lid 21 and includes a hollow cylindrical portion 221 having an outer thread 222 threadedly engaged with the inner thread 1131 of one of the first coupling portions 113 of the body 1. Two engagement pegs 211 are formed on the outer side of each lid 21 and are diametrically opposed to each other. Two engagement grooves 212 are defined in the outer side of each lid 21 and are diametrically opposed to each other. Each engagement peg 211 on each lid 21 includes an enlarged head 213 having a width larger than a width of a bottom of each engagement peg 211. Each engagement groove 212 of each lid 21 is elongated and arcuate and includes an insertion portion 214 and a coupling portion 215. The insertion portion 214 has a width larger than a width of each enlarged head 213 of each lid 21. The coupling portion 215 has a width smaller than the width of each enlarged head 213 of each lid 21. Each lid 21 includes an insertion hole 216 in a center thereof. The insertion hole 216 of each lid 21 includes a toothed inner periphery (217). The toothed inner periphery (217) is adapted to be extended and driven by a finger of a user.

The handle 3 includes two handle parts 31. Each handle part 31 removably extends through the insertion hole 216 of one of the lids 21. The handle parts 31 can detachably coupled with each other. One of the handle parts 31 includes an end having a thread 32. The other handle part 31 includes an end having a screw hole 32A. In assembly, the thread 32 in one of the handle parts 31 is threadedly engaged in the screw hole 32A of the other handle part 31. Each handle part 31 includes a flange 33 having an outer diameter larger than a diameter of the insertion hole 216 of each lid 21. After assembly, the flange 33 on each handle part 31 abuts the outer side of one of the lids 21.

With reference to FIG. 3, the second coupling portions 22 of the covers 2 can be threadedly engaged with the first coupling portions 113 of the body 1, and the handle 3 or other objects (not shown) can be received in the receiving portion 111 of the body 1 for easy carriage.

With reference to FIGS. 4-7, in a case that the user needs a longer massage roller, two bodies 1 of two massage rollers can be coupled with each other. Specifically, each engagement peg 211 on a lid 21 of one of the massage rollers extends into one of the insertion portions 214 on a lid 21 of the other massage rollers until the enlarged head 213 on the lid 21 of one of the massage rollers is on the inner side of the insertion portion 214 on the lid 21 of the other massage roller. Then, the massage rollers are rotated relative to each other (FIG. 5) until the enlarged heads 213 on the lid 21 of one of the massage rollers reach a position aligned with the coupling portions 215 on the lid 21 of the other massage roller. Since the width of each coupling portion 215 is smaller than the width of each enlarged head 213, the massage rollers will not disengage from each other, providing enhanced assembling reliability. Thus, two or more massage rollers can be assembled together to increase the overall length, increasing utility.

Figure 8:
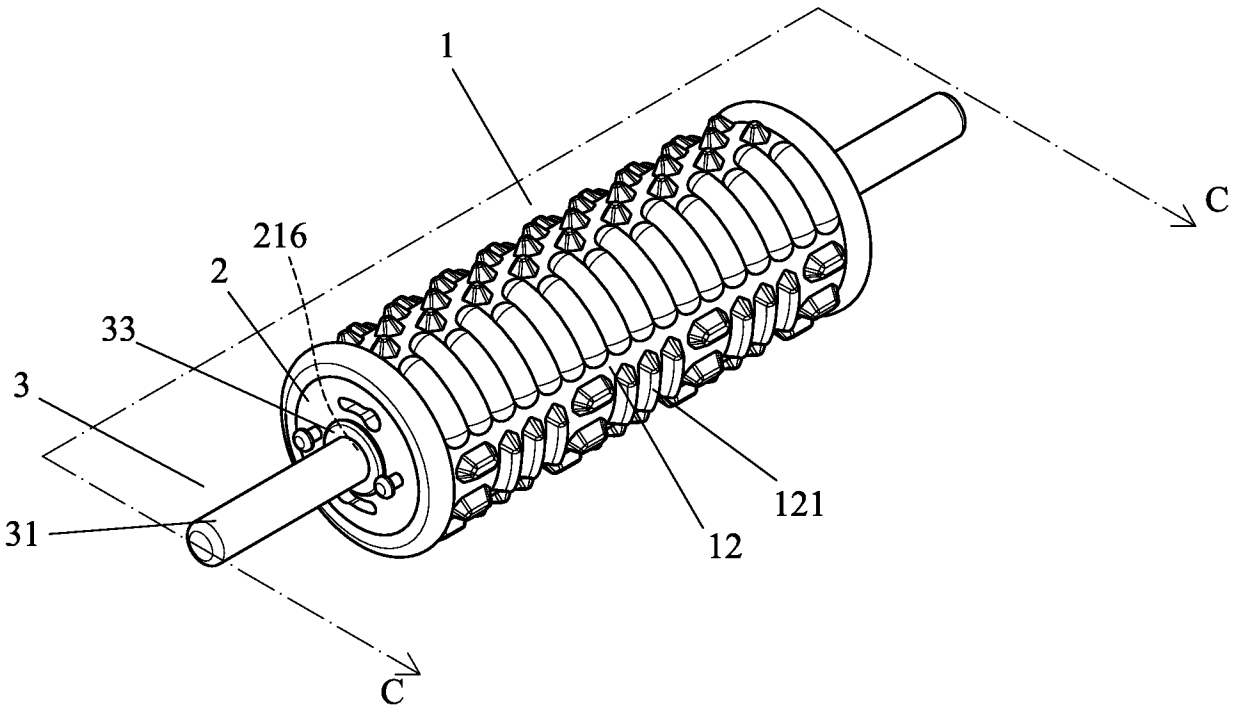
FIG. 8 is a perspective view of the massage roller device of FIG. 1, with the handle coupled to a body of the massage roller device.
Figure 9:
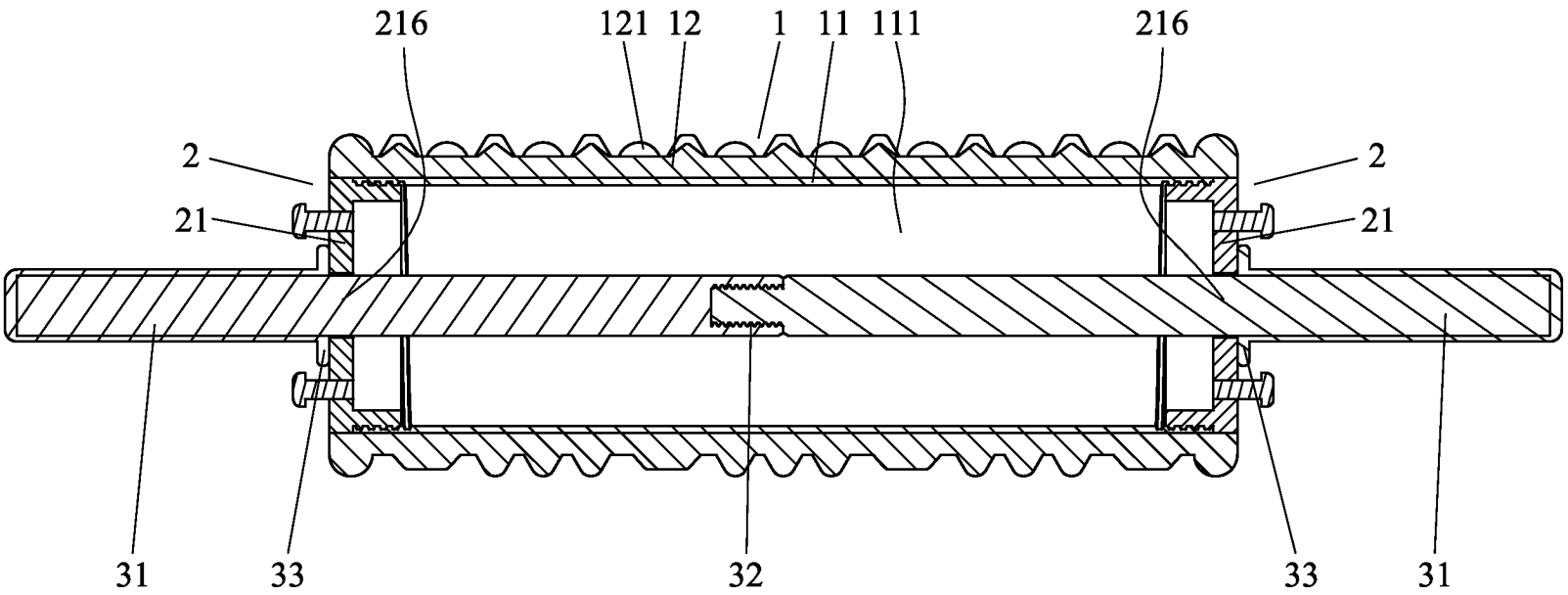
FIG. 9 is a cross sectional view taken along section line C-C of FIG. 8.

With reference to FIGS. 8 and 9, the handle 3 can be assembled with the body 1 according to need. In assembly, two handle parts 31 respectively extend through the insertion holes 216 of the covers 2 at two ends of the body 1. The thread 32 in one of the handle parts 31 is threadedly engaged in the screw hole 32A of the other handle part 31. The flange 33 on each handle part 31 abuts the outer side of one of the lids 21 to prevent the lid 21 from falling. The user can grip the handle parts 31 to rotate the body 1 for a massage effect or exercising effect. Thus, the massage roller can provide more exercising effects and more massage effects, increasing the utility and added value of the massage roller.

Figure 10:
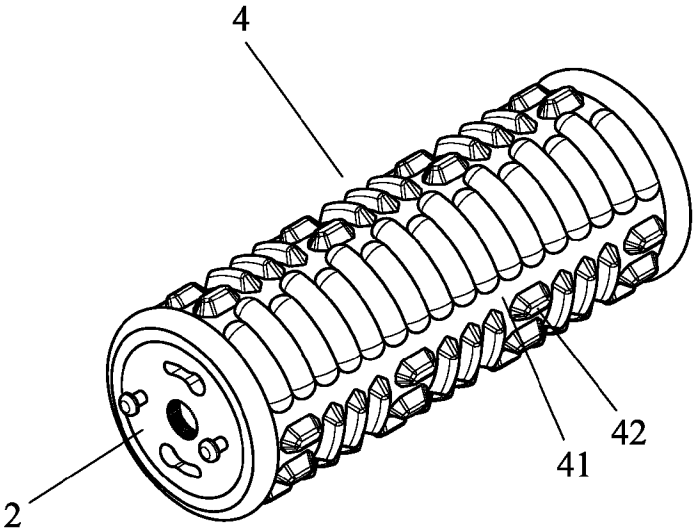
FIG. 10 is a perspective view of a massage roller device of a second embodiment according to the present invention.
Figure 11:
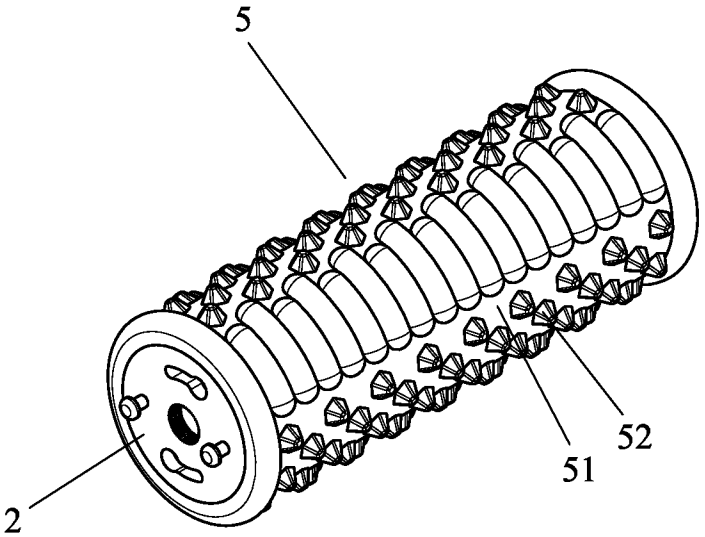
FIG. 11 is a perspective view of a massage roller device of a third embodiment according to the present invention.
Figure 12:
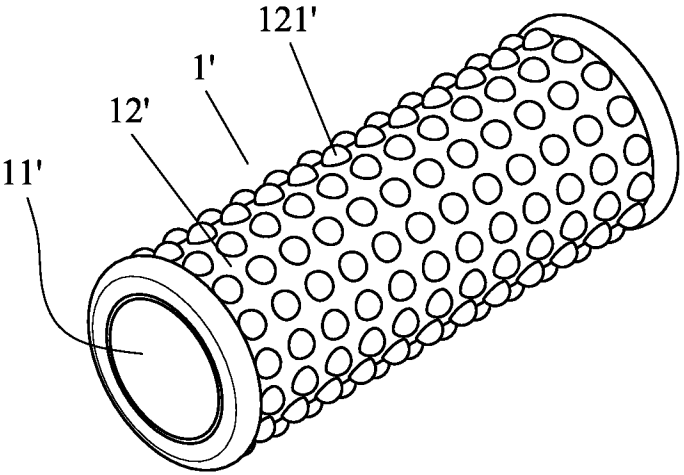
PRIOR ART FIG. 12
FIG. 12 is a perspective view of a conventional massage roller.

FIG. 10 shows a massage roller of a second embodiment according to the present invention, wherein the outer layer 41 mounted around the body 4 includes protrusions 42 of different sizes and shapes. FIG. 11 shows a massage roller of a third embodiment according to the present invention, wherein the outer layer 51 mounted around the body 5 includes protrusions 52 of different sizes and shapes. The covers 2 can be used to connect two or more massage rollers having different protrusions to increase utility.

The massage rollers according to the present invention provide enhanced utility. However, each engagement groove 212 does not have to include the insertion portion 214 and the coupling portion 215. In this case, the engagement pegs 211 on a massage roller can be directly and forcibly extended through the engagement grooves 212 on another massage roller by using flexibility of each cover 2.

Although specific embodiments have been illustrated and described, numerous modifications and variations are still possible without departing from the scope of the invention. The scope of the invention is limited by the accompanying claims.

The invention claimed is:

1. A massage roller device comprising:

a body including a tube and an outer layer, with the tube being rigid and including a receiving portion having two openings, a first coupling portion provided in each of the two openings, with the outer layer made of a soft material and mounted around the tube; and two covers made of a rigid material, each of the two covers covering one of the two openings of the body, each of the two covers including a lid having an inner side and an outer side opposite to the inner side, a second coupling portion provided on the inner side of each lid, with two engagement pegs formed on the outer side of each lid, and two engagement grooves defined around an insertion hole on the outer side of each lid, each of the two engagement pegs on each lid including an enlarged head, each of the two engagement grooves of each lid including an insertion portion and a third coupling portion (215), the insertion portion having a width larger than a width of each enlarged head of each lid, and the third coupling portion (215) having a width smaller than the width of each enlarged head of each lid, each lid including the insertion hole in a center thereof, a handle, including two handle parts, made of rigid materials not for bending, with each of the two handle parts removably extending coaxially with the receiving portion through the insertion hole of one of the lids, and the two handle parts detachably coupled with each other, wherein a length of the handle parts is less than that of the body, when being assembled, turning the handle parts rotates the body, and when being disassembled, the handle parts are completely received in the receiving portion of the body and disposed next to each in parallel to the receiving portion, with at least an end of each of the handle parts received in the opening which immediately neighbors a hollow cylindrical portion of the second coupling portion, the body of the massage roller can be coupled with another body of another massage roller via the engagement peg on the lid of the massage roller which extends into one of other insertion portions on another lid of another massage roller, with one of the handle parts including an end having a thread, another of the two handle parts including an end having a screw hole, the thread of one of the two handle parts threadedly engaged in the screw hole of the other of the two handle parts, each of the two handle parts including a flange having an outer diameter larger than a diameter of the insertion hole of each lid, and the flange on each of the two handle parts abutting the outer side of one of the lids.

2. The massage roller device as claimed in claim 1, with each of the first coupling portions of the body including an inner thread, with the second coupling portion of each of the two covers including a cylindrical portion having an outer thread threadedly engaged with the inner thread of one of the first coupling portions of the body.

3. The massage roller device as claimed in claim 1, with the insertion hole of each lid including a toothed inner periphery, with the toothed inner periphery adapted to be extended and driven by a finger of a user.

* * * * *